US006386273B1

(12) United States Patent
Hateley

(10) Patent No.: US 6,386,273 B1
(45) Date of Patent: May 14, 2002

(54) HEAT EXCHANGER ASSEMBLIES FOR VEHICLES

(75) Inventor: Ian J Hateley, West Midlands (GB)

(73) Assignee: Grayson Automotive Services Limited, Birmingham (GB)

( * ) Notice: Subject to any disclaimer, the term of this patent is extended or adjusted under 35 U.S.C. 154(b) by 0 days.

(21) Appl. No.: 09/646,155

(22) PCT Filed: Mar. 15, 1999

(86) PCT No.: PCT/GB99/00679

§ 371 Date: Nov. 13, 2000

§ 102(e) Date: Nov. 13, 2000

(87) PCT Pub. No.: WO99/47875

PCT Pub. Date: Sep. 23, 1999

(30) Foreign Application Priority Data

Mar. 14, 1998 (GB) ..... 9805379

(51) Int. Cl.[7] ..... F28F 9/00

(52) U.S. Cl. ..... 165/67; 165/69; 165/149; 165/78; 180/68.4

(58) Field of Search ..... 165/67, 41, 76, 165/78, 149; 180/68.4

(56) References Cited

U.S. PATENT DOCUMENTS

| | | | | | |
|---|---|---|---|---|---|
| 1,593,244 | A | * | 7/1926 | Cutler | 180/68.4 |
| 4,315,540 | A | * | 2/1982 | Moranne | 165/67 |
| 4,403,648 | A | * | 9/1983 | Styok | 165/76 |
| 5,088,572 | A | * | 2/1992 | Schroeder et al. | 180/300 |
| 5,360,059 | A | * | 11/1994 | Olson | 165/149 |
| 5,597,047 | A | * | 1/1997 | Thompson et al. | 180/68.4 |
| 6,129,142 | A | * | 10/2000 | Beldam | 165/81 |

* cited by examiner

*Primary Examiner*—Allen Flanigan
(74) *Attorney, Agent, or Firm*—Pillsbury Winthrop LLP

(57) ABSTRACT

A heat exchanger unit (10) comprises a core (25) and manifold (22, 23) assembly (14) mounted in a rectangular sub-frame (13). The sub-frame (13) comprises a U-shaped member (20) the opposed limbs (24) of which form confronting channels receiving side portions of the assembly (14), and a cross-member (21) secured to the assembly (14) and releasably secured to the ends of the limbs (24) to complete the rectangular sub-frame (13) and retain the assembly (14) in it. The unit (10) is fitted to a vehicle with the U-shaped member (20) in an inverted position so that with the cross-member (21) disconnected from it the assembly (14) can be slid into and out of the sub-frame (13) from beneath the vehicle.

8 Claims, 3 Drawing Sheets

HEAT EXCHANGER ASSEMBLIES FOR VEHICLES

This application is the national phase of international application PCT /GB99/00679 filed Mar. 15, 1999 which designated the U.S.

This invention concerns heat exchanger assemblies, for internal combustion engine vehicles including vehicles such as motor omnibuses, coaches and like multi-passenger road vehicles, which are hereinafter collectively referred to as "buses".

A problem common to vehicles is overheating caused by the engine cooling heat exchanger becoming blocked or partially blocked to the flow of air therethrough by the accumulation of dirt and debris on the heat exchanger (commonly called the "radiator"). This problem is particularly severe in urban and city areas in which buses operate.

For many years buses were configured with engines at the front and the radiators mounted in front of the engines to face the incident air flow. To facilitate steam cleaning of such forward facing radiators, we developed a strong rectangular peripheral sub-frame in which a relatively weak radiator core and manifold assembly was supported and held by retaining means so that forwards removal of the retaining means enabled the assembly to be moved in a forwards direction (nominally perpendicular to the median plane of the sub-frame) to facilitate cleaning of the core without having first to dismantle the sub-frame from the bus.

However this expedient is not applicable to the newer rear engined buses, in which the packing density of the engine, its ancillaries and cooling system is much greater than that of front engined buses. Thus, at present it takes some 7 to 8 man hours to remove a radiator from a typical rear engined modern bus.

The current requirements for compact and complex heat exchanger installations comprising a radiator, an intercooler and an oil cooler with one or more cooling air flow boost fans and the cowlings thereof, exacerbate the problems of inaccessibility and cleaning (particularly removal for steam cleaning) of the radiator.

In order to solve the aforementioned problems, according to the present invention there is provided a heat exchanger unit which includes a core and manifold assembly supported by and mounted in a rectangular sub-frame, characterised in that the sub-frame comprises a U-shaped member, in that the opposed parallel limbs of the U-shaped member form confronting channels to receive side portions of the assembly, and in that the sub-frame further comprises a cross-member secured to the core and manifold assembly and releasably secured to the U-shaped member to retain said assembly in said channels.

Release of the cross-member allows said assembly to be slid out of the channels so that the assembly can be slid out of the sub-frame in the median plane of the frame.

The sub-frame preferably provides mountings for locating an intercooler to one side of the core and manifold assembly, and a fan and cowl to the other side of said assembly. The mountings for the intercooler are preferably provided on the cross-member. Further mountings may be provided on the sub-frame for an oil cooler alongside the intercooler.

The cross-portion of the U-shaped member joining the parallel limbs thereof preferably provides abutments for anti-vibration means providing support for said assembly, and, preferably, also for the intercooler.

The heat exchanger unit is preferably fitted to a vehicle with the U-shaped member in an inverted position so that the core and manifold assembly can be slid into and out of the sub-frame from beneath the vehicle.

The invention also provides a method of removing a radiator from a heater exchanger unit in which a rectangular sub-frame includes a cross-member which is secured to one end or margin of the radiator, which method is characterised in that said cross-member is separated from the rest of the sub-frame to allow the radiator to be slid out of the rest of the sub-frame in a direction extending in the installed plane of the radiator.

This method allows removal of the radiator without prior removal of other heat exchangers or cooling fans installed in planes alongside said installed plane of the radiator.

The invention will be described further, by way of example, with reference to the accompanying diagrammatic drawings, wherein.

Figure 1:
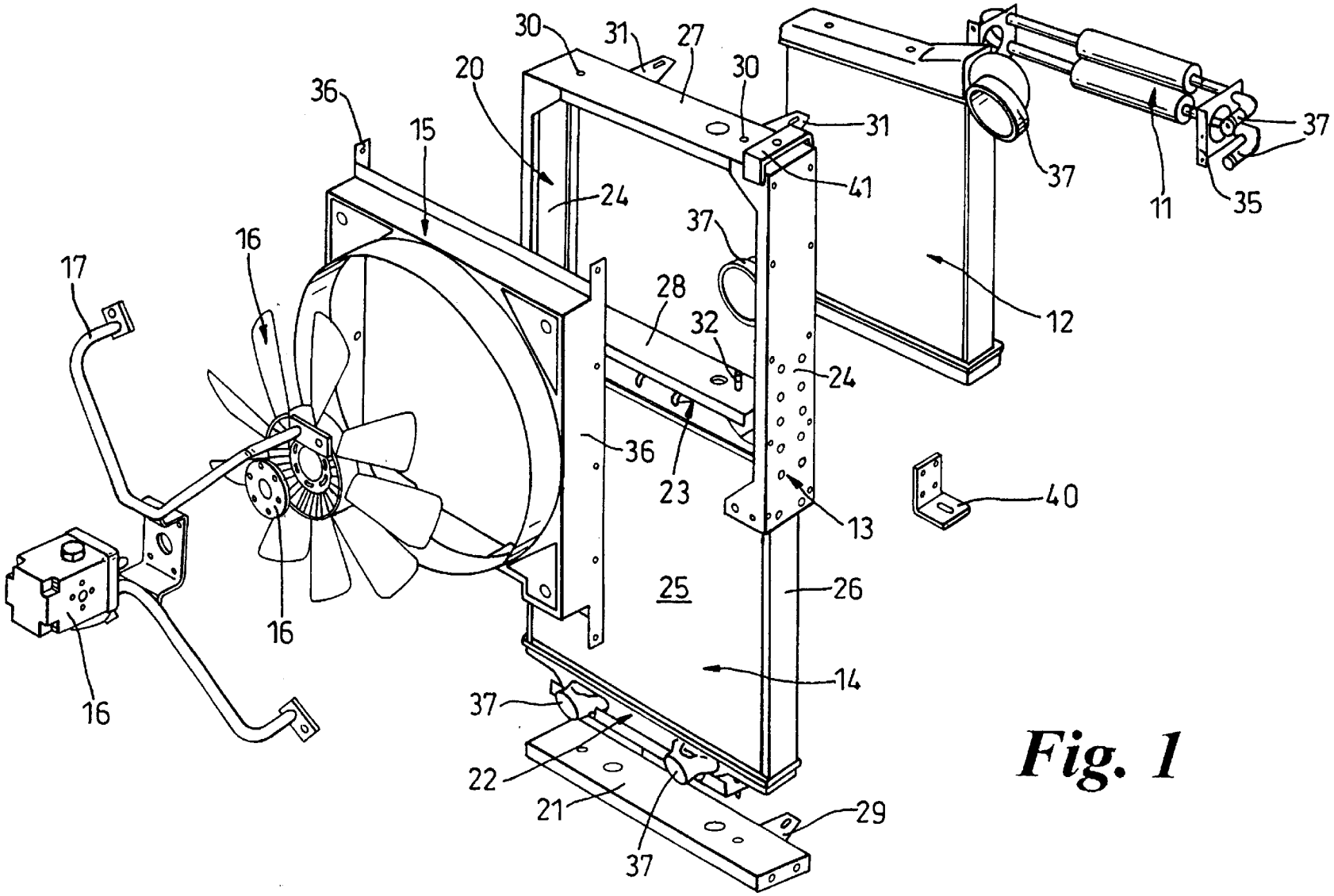
FIG. 1 is an exploded perspective view of a heat exchanger unit of the invention showing the major parts of the unit.
Figure 2:
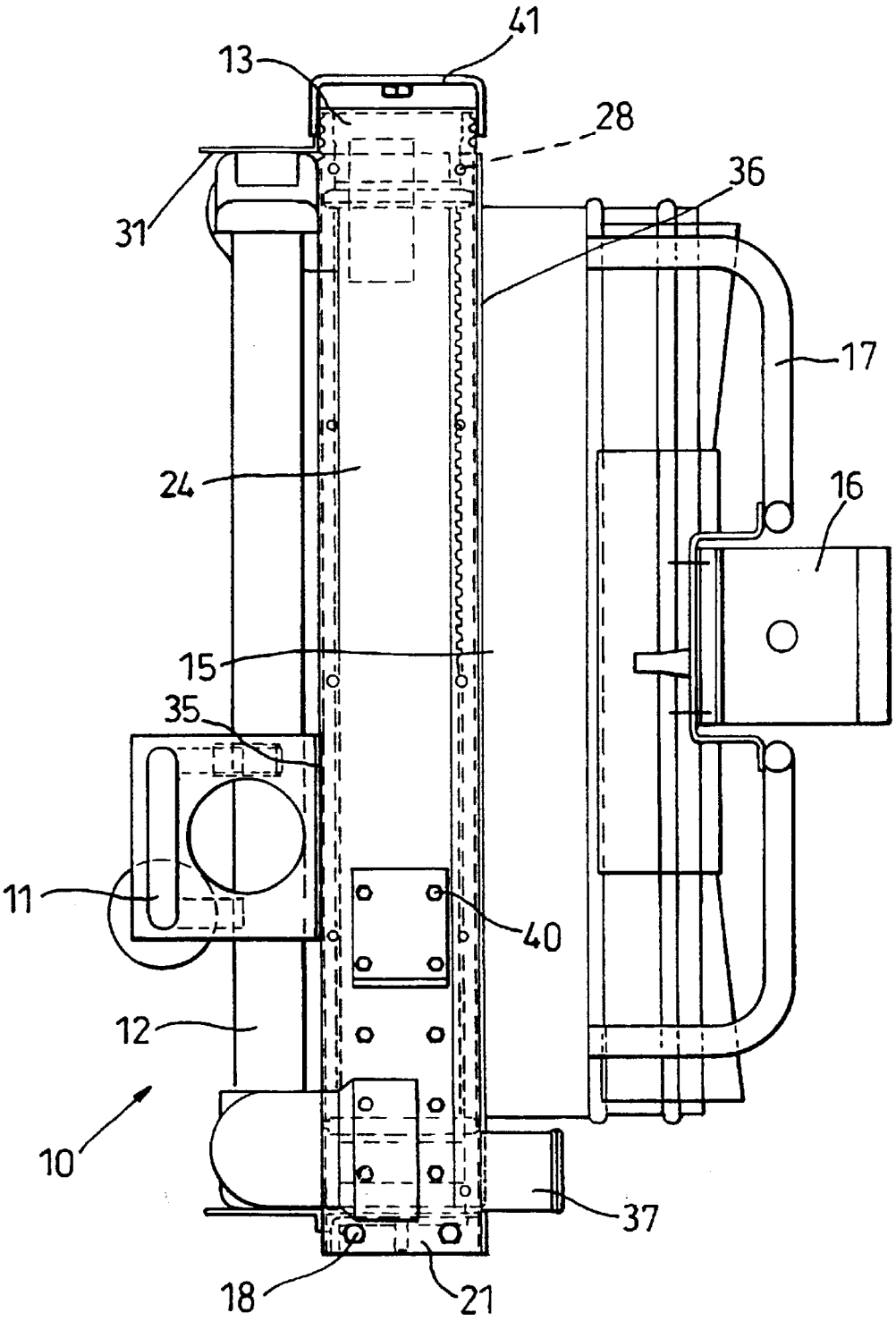
FIG. 2 shows the assembled unit in side elevation.
Figure 3:
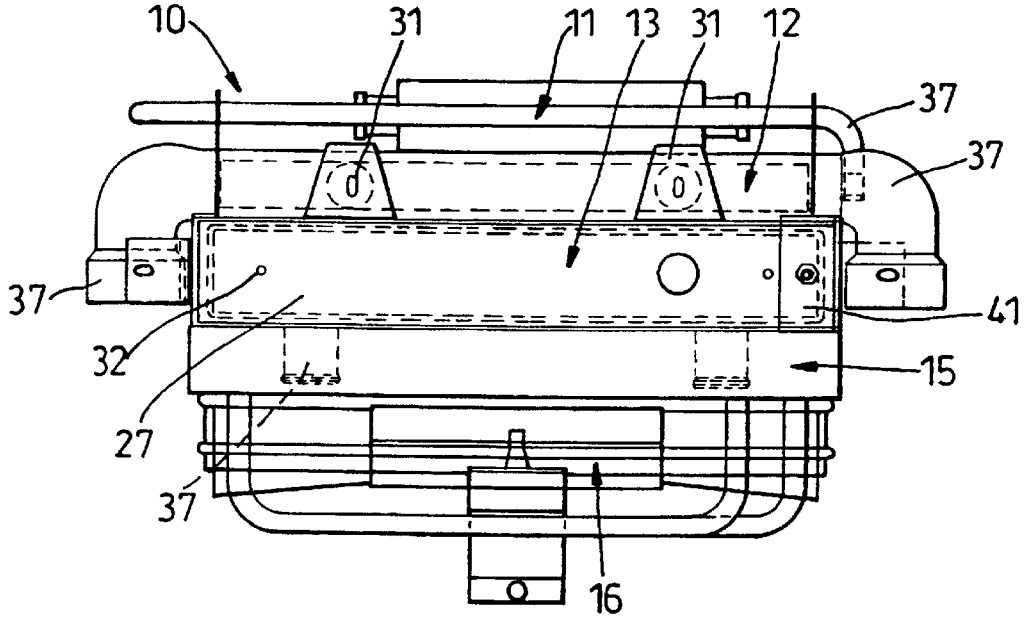
FIG. 3 shows the unit in plan.

Referring to the drawings, the heat exchanger unit 10 includes an oil cooler 11 (in the form of an oil to air heat exchanger), an intercooler 12 (in the form of an air to air heat exchanger) which is sometimes called a "charge cooler", a radiator sub-frame 13, a radiator manifold and core assembly 14 (in the form of a water to air heat exchanger), a fan cowl 15 and a fan unit 16.

The sub-frame 13 is rectangular and includes a U-shaped member 20 intended to be mounted in a vehicle in an inverted position as shown in the drawings, and a cross member 21 which (although shown separate in FIG. 1) is welded or brazed to the lower one of two end manifolds 22 and 23 of the radiator manifold and core assembly 14. The cross member 21 is securable at its ends by fasteners 18 between the lower portions of the two parallel limbs 24 of the U-shaped member 20 to complete the rectangular sub-frame 13. The limbs 24 define confronting channels in which the aforesaid assembly 14 is located.

The assembly 14 includes a core 25 extending between the manifolds 22 and 23, which core 25 has lateral plates 26 which are a close sliding fit in the channels, so that the assembly 14 is slidably removable from the U-shaped member 20 when the cross-member 21 is detached from the limbs 24.

The U-shaped member 20 has a cross portion 27 which bridges the limbs 24, and the other manifold 23 has an end portion 28 which fits into said cross portion 27.

The cross-member 21 carries mountings 29 (in the form of lugs) to which the lower end of the inter-cooler 12 is releasably secured by fasteners, but in other embodiments the mountings 29 may be releasably secured to the lower end portions of the limbs 24.

Figure 4:
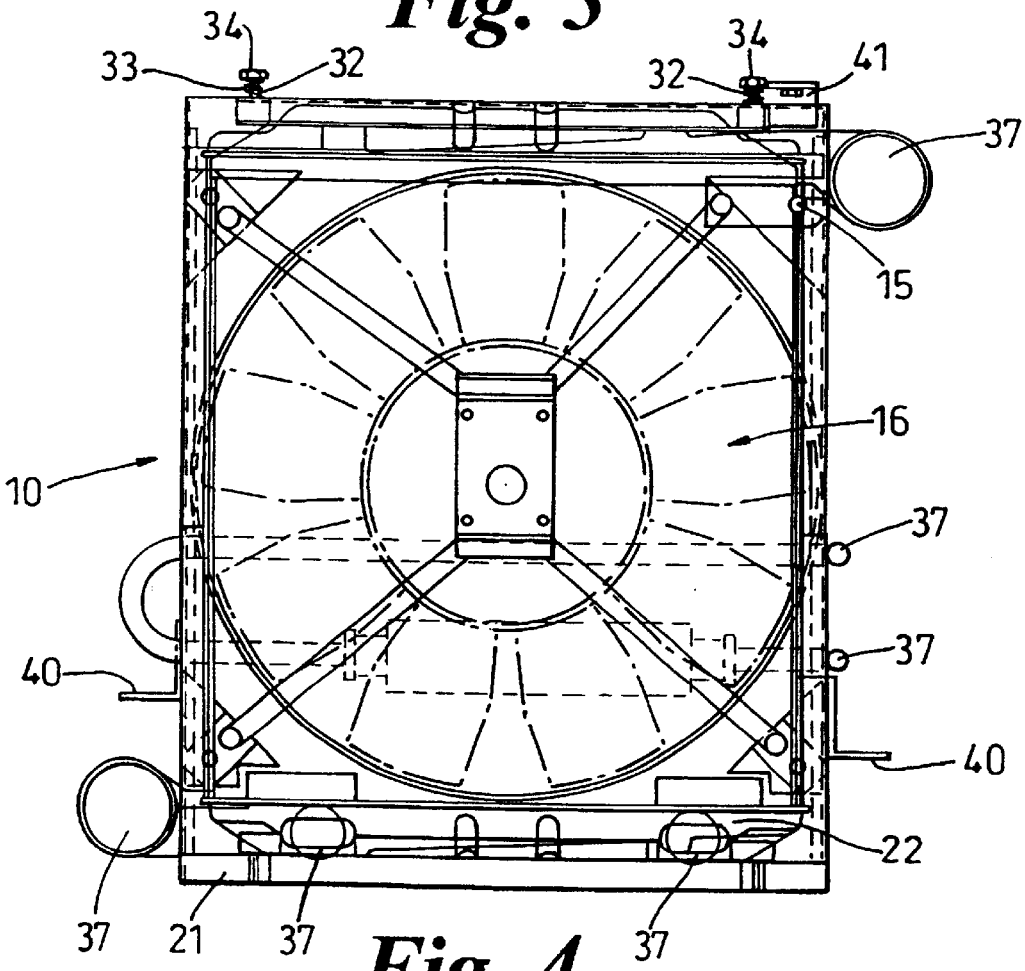
FIG. 4 shows the unit in rear elevation.

The cross portion 27 provides abutments 30 (in the form of apertures) to receive anti-vibration means which connects the end portion 28 with the cross portion; and provides further abutments 31 (in the form of apertured lugs) to receive locators which connect the upper end of the intercooler 12 with said abutments 31. In this embodiment the anti-vibration means comprises a pair of bolts 32 (FIG. 4) secured to the end portion 28, a coil spring 33 around each bolt, and a nut 34 to clamp the coil spring against the abutment. In other embodiments the bolts 32 may be replaced by pegs (not shown) and the springs may be replaced by elastomeric bodies which are secured to the cross-portion and which are apertured to receive the pegs.

The locators in this embodiment are similar to either form of the anti-vibration means. Both forms of anti-vibration means permit the radiator to expand vertically relative to the sub-frame, but the form employing bolts and nuts requires access to be provided to the upper end of the unit 10 for final release of the radiator and/or the intercooler when the cross-member 21 is unfastened from the lower ends of the limbs, whereas in the other form the pegs may be withdrawn from the bushes when the radiator and/or intercooler is or are moved downwards.

Both of the oil cooler 11 and the cowl 15 have respective mounting flanges 35 and 36 by means of which they are releasably fastened to the limbs 24, e.g. by fasteners which are accessible when the radiator 14 is removed. The fan unit 16 is connected to the cowl 15 by a spider mounting 17.

All the fluid connectors 37 for oil, air and water flowing to and from the heat exchangers, face in a common direction and are exposed at the periphery of the sub-frame 13, to facilitate fitting and removal of hoses and pipes.

The entire assembly 10 will usually be mounted on vibration damping mountings (not shown) provided on a vehicle's structure by means of a pair of strong brackets 40 releasably secured to the lower portions of the limbs 24 and at least one downwardly open inverted U-shaped locator 41 supported by a further vibration damping mounting on the vehicle to receive the cross portion 27, to steady the upper end of the assembly 10, so that the entire assembly is easily removable from the vehicle after disconnection of the fluid ducts, such as the hoses and pipes, the power supply to the fans, and the usual electrical connections to sensors e.g. thermostats, for removal and replacement e.g. after an accident.

With the U-shaped member 20 mounted in an inverted position in a vehicle, for example a bus, the radiator manifold and core assembly 14 can be slid upwardly into position in the sub-frame 13 and downwardly out of the sub-frame, so that removal and replacement of the assembly can be performed from beneath the vehicle.

The invention is not confined to details of the foregoing example and many variations, modifications and mechanical or functional equivalents or parts and fasteners specifically disclosed are included within the scope of the invention. The invention further includes an assembly or method incorporating any part, functional feature or operation herein or in the drawings disclosed, any combination thereof, or any mechanical equivalent thereof.

I claim:

1. A heat exchanger unit which includes a core and manifold assembly supported by and mounted in a rectangular sub-frame, characterised in that the sub-frame comprises a U-shaped member, in that the opposed parallel limbs of the U-shaped member form confronting channels to receive side portions of the assembly, and in that the sub-frame further comprises a cross-member secured to the core and manifold assembly and releasably secured to the U-shaped member to retain said assembly in said channels.

2. A heat exchanger unit as claimed in claim 1 in which the sub-frame provides mountings for locating an intercooler to one side of the core and manifold assembly, and a fan and cowl to the other side of said assembly.

3. A heat exchanger unit as claimed in claim 2 in which the mountings for the intercooler are provided on the cross-member.

4. A heat exchanger unit as claimed in claim 2 or 3 in which further mountings are provided on the sub-frame for an oil cooler alongside the intercooler.

5. A heat exchanger unit as claimed in any one of the preceding claims in which the cross-portion of the U-shaped member joining the parallel limbs thereof is provided with anti-vibration means providing support for for said assembly.

6. A heat exchanger unit as claimed in claim 5 in which the anti-vibration means comprise elastomeric bodies secured to the cross-portion and formed with apertures to receive pegs provided on said assembly.

7. A heat exchanger unit as claimed in any one of the preceding claims which is fitted to a vehicle with the U-shaped member in an inverted position so that the core and manifold assembly can be slid into and out of the sub-frame from beneath the vehicle.

8. A method of removing a radiator from a heater exchanger unit in which a rectangular sub-frame includes a cross-member which is secured to one end or margin of the radiator, which method is characterised in that said cross-member is separated from the rest of the sub-frame to allow the radiator to be slid out of the rest of the sub-frame in a direction extending in the installed plane of the radiator.

* * * * *